US006431371B1

(12) United States Patent
Tonon

(10) Patent No.: US 6,431,371 B1
(45) Date of Patent: Aug. 13, 2002

(54) NEWSSTAND DISPLAY MODULE

(76) Inventor: Wallace Ricardo Tonon, 694/301 Rua Joao Antonio Cardoso, Ouro Preto Belo Horizonte, Minas Gerais 31310-390 (BR)

( * ) Notice: Subject to any disclaimer, the term of this patent is extended or adjusted under 35 U.S.C. 154(b) by 0 days.

(21) Appl. No.: 09/471,822

(22) Filed: Dec. 23, 1999

(51) Int. Cl.[7] ..... A47F 5/00

(52) U.S. Cl. ..... 211/50; 211/128.1; D25/16; D6/470

(58) Field of Search ..... 211/50, 55, 128.1; 312/117, 128, 136; D25/16; D6/470, 474, 476

(56) References Cited

U.S. PATENT DOCUMENTS 3,777,897 A * 12/1973 Gray ..... 211/55
D249,433 S * 9/1978 Carlsen
4,236,359 A * 12/1980 Woolford
D265,024 S * 6/1982 Johnson et al.
4,471,586 A * 9/1984 Shuch et al.
5,226,266 A * 7/1993 Cernuto ..... 211/55 X
D370,140 S * 5/1996 Gaietto ..... D6/474
D377,566 S * 1/1997 Norge ..... D25/16 X
5,692,342 A * 12/1997 Devlin ..... D6/470 X
5,718,398 A * 2/1998 Ross
D410,288 S * 5/1999 Kleihues ..... D25/16
D411,017 S * 6/1999 Kleihues ..... D25/16
D421,349 S * 3/2000 Pierson

* cited by examiner

*Primary Examiner*—Robert W. Gibson, Jr.
(74) *Attorney, Agent, or Firm*—Darby & Darby

(57) ABSTRACT

A newsstand module having a triangular shaped module which is composed of similarly juxtaposed lateral shelves, one front module, one back module showcase, an upper display area, one storage room coupled with a safe and a neon sign. The display module permits a computer operator to have full visual control of a store room. In addition, sales are computer operated via a bar code optical reader.

9 Claims, 7 Drawing Sheets

Figure 3:
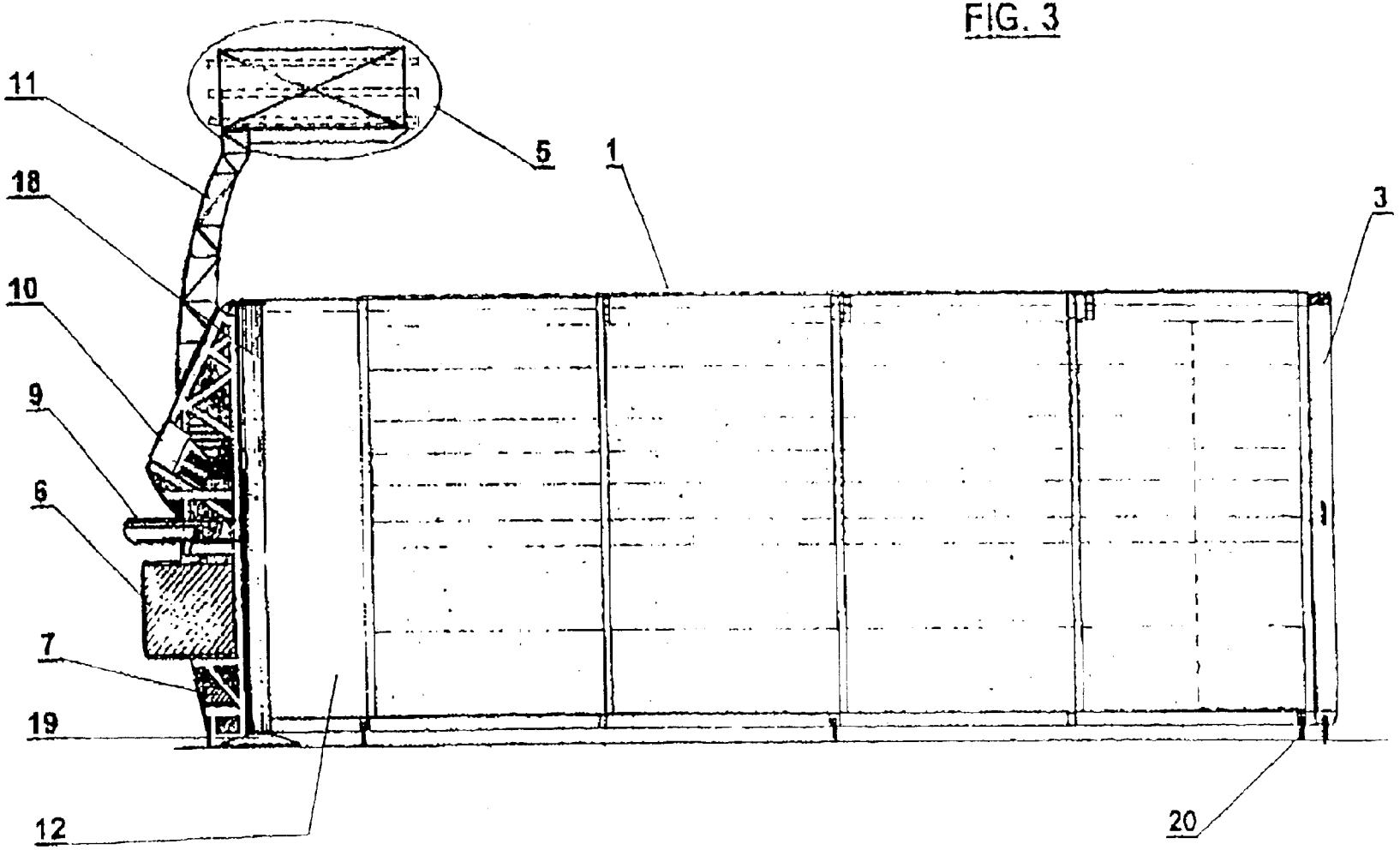

FIG. 1
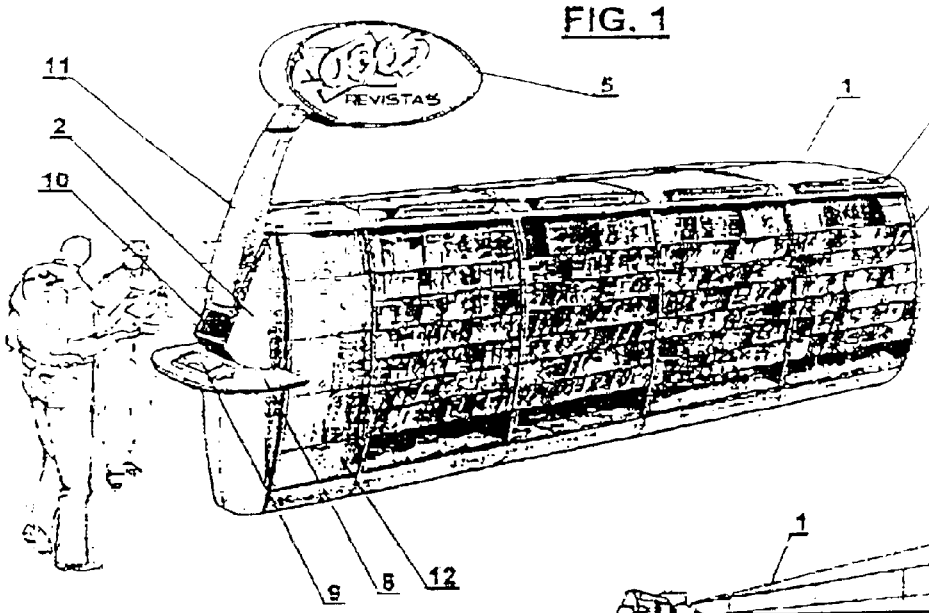
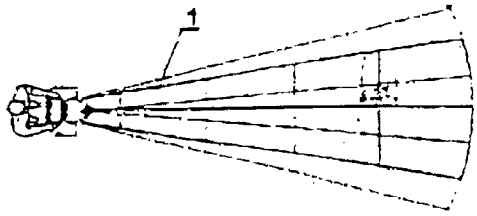
FIG. 2

NEWSSTAND DISPLAY MODULE

BACKGROUND AND SUMMARY OF THE INVENTION

Patent application of a newsstand display module bearing a triangular shaped module composed of similar juxtaposed lateral shelves, one front module, one back showcase, upper display area, one storage room coupled with a safe and a neon sign.

This display module developed from a proposal which includes the display of a wide range of magazines, newspapers and sundry products to be commercialized in market spots inside shopping centers. The modular display design allows for the operator to have full visual control of the store from a priviledged standpoint. Sales are computer operated by means of a bar code optical reader.

The caster-supported display module occupies an area of eight square meters (8 m2), which is significantly smaller than the area occupied by the traditional newsstand (18 m2). The module holds a large storage compartment and a security safe. The storage compartment has side shelves to hold the products which are not on display. The operator has access to this area through a back door. Two glass windows display products on the back of the module. The safety system of the display module makes use of a canvas cover which is locked with a padlock whenever the module is not being operated.

In the traditional newsstand, customers are not offered easy access to the goods on sale as no more than a hundred products can be on display in its external areas. Differently, the display areas of this module may hold as many as 1500 different titles grouped in specific sections or ten times the number of titles displayed in the traditional newsstand. Customers are offered a self-service system. This mode of organization makes it easier for customers to browse comfortably through magazines and newsapers, find the subjects of their choice and read a few articles. This is another advantage of this display module where the customer is offered full access to all the products on sale. Another advantage it has over the existent newsstands is its internal storage area, which can hold as many as 3.000 titles, or double the amount of merchandise stored in traditional newsstands.

The drawings included in this descriptive report contain numeric references and a detailed description of the display module. The module configurations, proportions, dimensions and types of covering are not determined in the drawings as they are not relevant to this patent application. They can be determined by specific needs at the time of the industrial production. The drawings are illustrative of the functional features of the module.

BASIC DESCRIPTION OF THE DRAWINGS

FIG. 1: module in perspective and in operation.

FIG. 2: module from the top.

FIG. 3: side view of the module. The internal operational area of the module is shown in detail.

Figure 4:
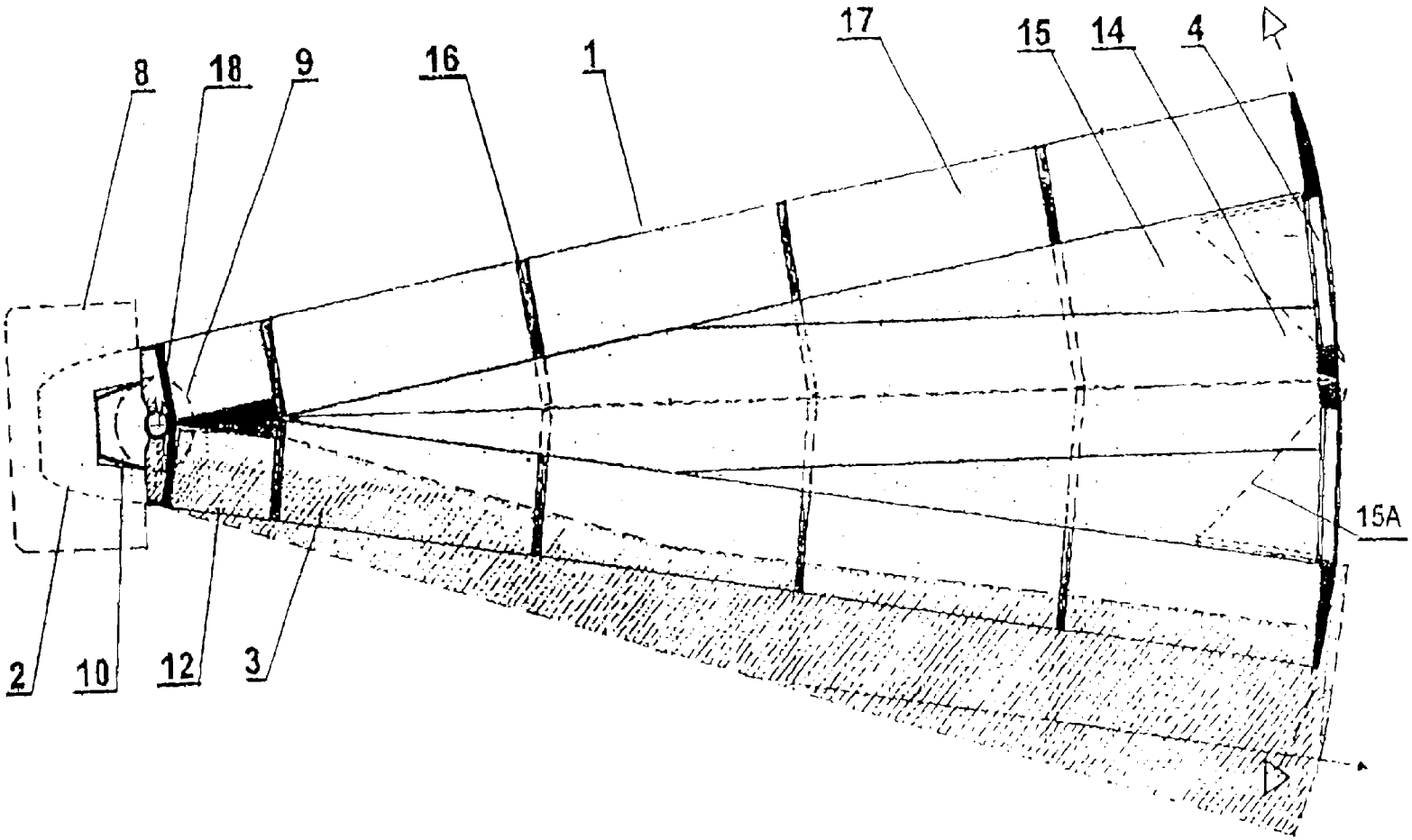

FIG. 4: operational area from the top. The cover was removed to allow for a view of the internal features of the storage room.

Figure 5:
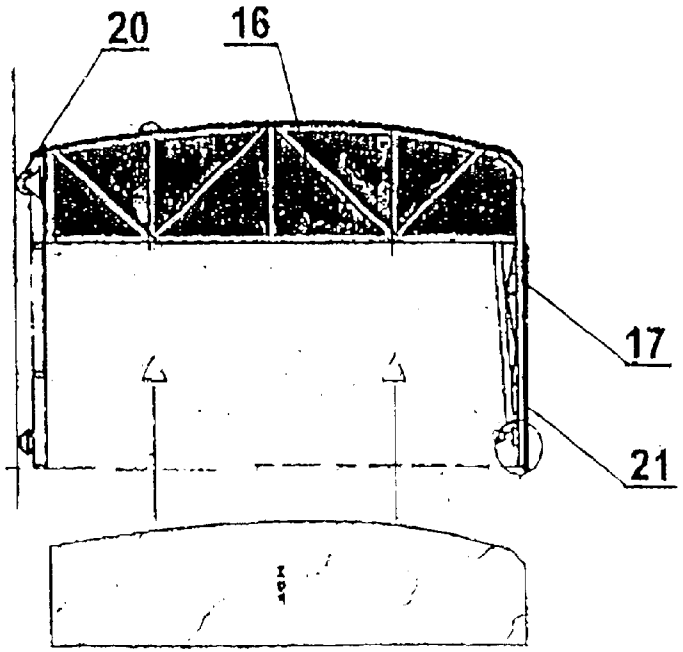
Figure 6:
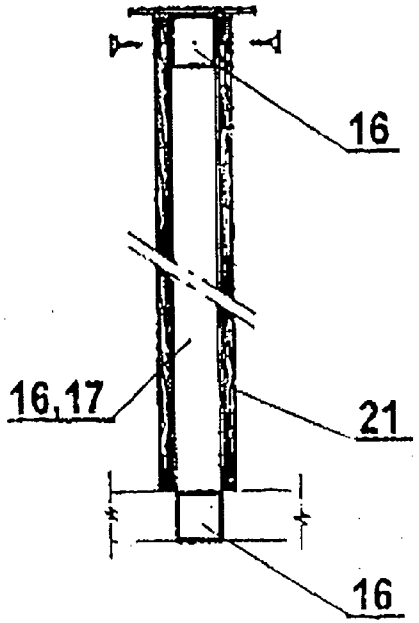
Figure 7:
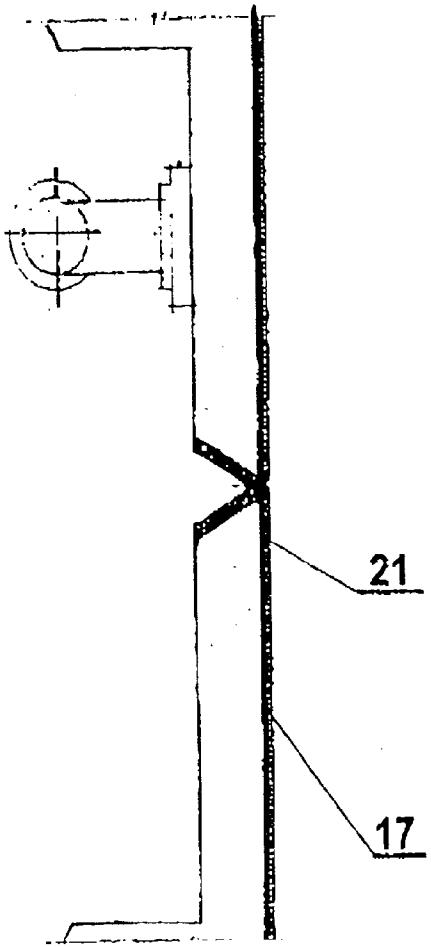
Figure 8:
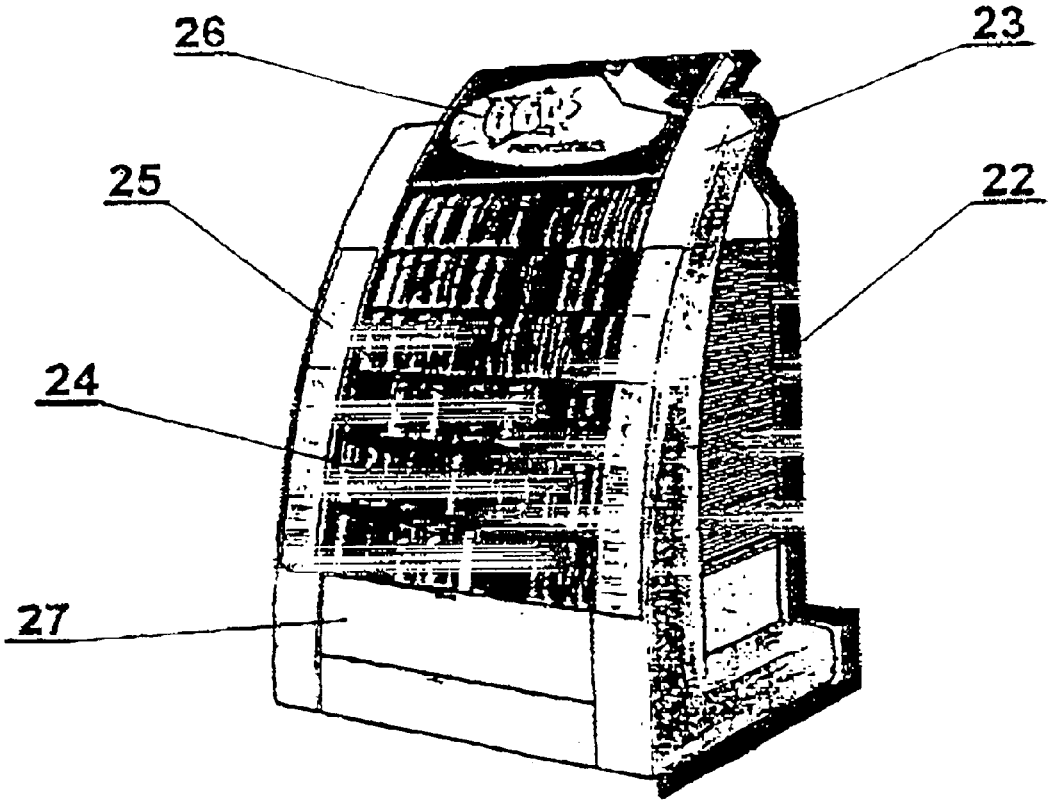

FIGS. 5, 6 and 7: transverse view of the back area of the module (identical halves); detailed view of the structure and plate joint; detailed view of the covering and modules joint.

Figure 9:
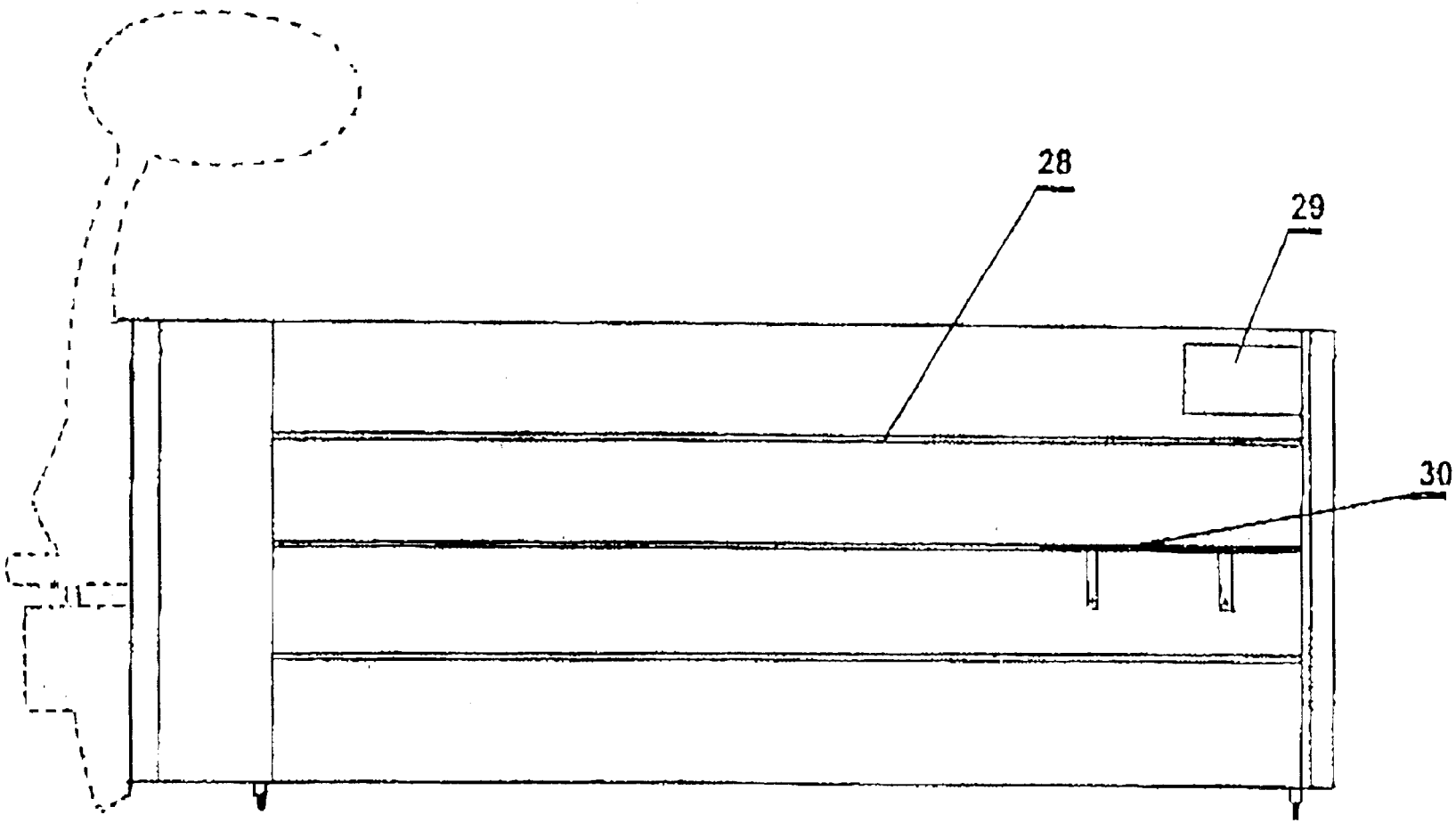
Figure 10:
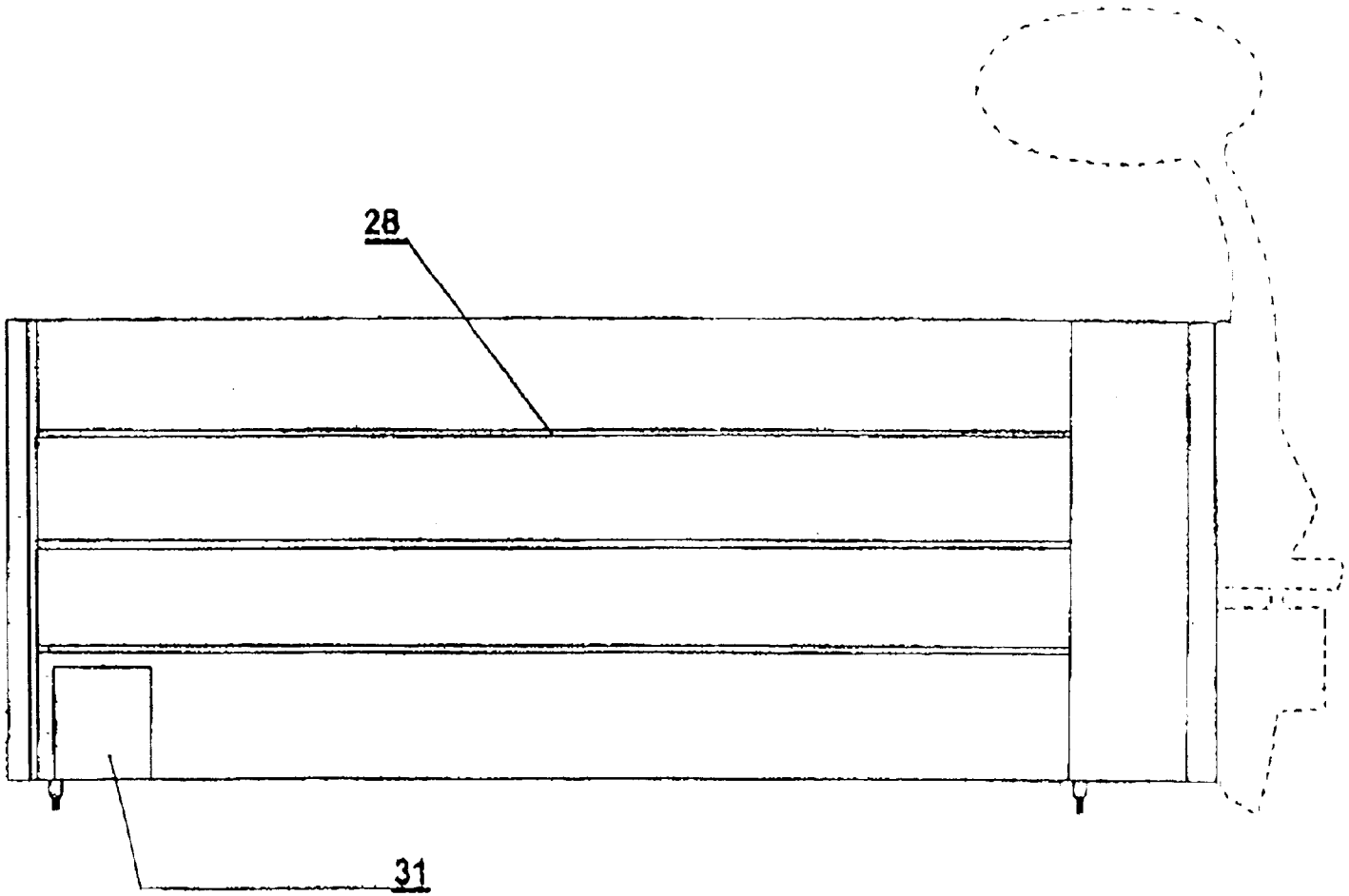

FIGS. 9 and 10; front view of the internal area left and right modules. These modules form the storage area and the administrative maintenance area.

DETAILED DESCRIPTION OF THE DRAWINGS

Based on the drawings, this patent application, describes a triangular (1) newsstand display module which has functional characteristics and contains one front module (2), two lateral modules (3), a back showcase (4) and (5) a neon sign.

The front module (2) contains internal areas to house the CPU (6) and the stabilizer (7), a shelf (8) to hold the keyboard (9) and a monitor (10). These areas receive lateral ventilation. A tower (11) is projected above the monitor (10) and supports an elliptical neon sign. The monitor is placed above the keyboard shelf (8).

The modules placed on the right and left sides of the newsstand (3) divide in horizontal sections. Sundry products are displayed in the smaller section (12). The origin and the subject of the publications are shown on cards (13) placed on the upper part of the shelves. Target costumers are also indicated. The back window (4) covers a door which gives access to the bottom of the module. When open, it creates a 0,60 m long corridor (14) leading to the internal storage room (15).

The storage room serves also as the administrative maintenance area and is supported by the internal structure of the left and right sidel modules. These contain horizontal sections (28) which end up, on the left, in a variant oblique extension (15 A) attached to the lateral end of the back window. A safe (31) is placed inside this module. The power panel (29) is placed within the right side module. A small table (30), which is itself the front extension of the second internal section, allows for the operator to handle papers and small objects.

The display module construction is supported by metallic profiles, which function as dividers (16), the structure of the upper section (17), structure of the front module (2) and structure of the neon sign tower (5). These are supported by a central metallic column (18) placed on an adjustable threaded metallic support (19). The module opening system is placed on five fixed casters and polyurethane wheels (20). For aesthetic purposes, the internal and external structures are covered with compressed wood covering, rubber, canvas and carpet. Module shelves, lateral display areas (3) and neon sign tower (5) are made of flat metal plates.

This newsstand display module is an innovative model of convenience and can be operated by only one salesperson. Due to its triangular shaped design and functional characteristics, the operator has full visual control of the unit. The unit has a safe storage area and offers the customers comfortable and easy access to the publications. As compared to the modes of commercialization of newspapers and magazines existent, this project offers a more efficient service and a better quality store design. Based on its innovative design features, the optimization of services and the advantages it offers over the newsstands existent, the display module described here bears all the prerequisites of a novel project to be granted a patent.

I claim:

1. A triangular newsstand display module, comprising:

a front module;

right and left side modules coupled to the front module;

a back showcase coupled to each of the right and left side modules;

a neon sign disposed above the front module; and a tower supporting the neon sign.

2. The display module of claim 1, wherein said front module comprises:

an internal area;

a shelf within the internal area;

a CPU and a stabilizer housed in the internal area; and a keyboard placed on the shelf.

3. The display module of claim 2, further comprising:

a back window providing access to the front module; and a monitor coupled to the CPU.

4. The display module of claim 3, further comprising:

an internal storage module arranged between the back window and the right and left side modules.

5. The display module of claim 4, wherein the back door creates a long corridor which leads to the internal storage room.

6. The display module of claim 5, wherein the corridor is 0.6 m long.

7. The display module of claim 4, wherein the internal storage area is an administrative maintenance area.

8. The display module of claim 1, wherein the left and right modules are metallic and divide into horizontal sections.

9. The display module of claim 4, further comprising:

an oblique extension adjoined to the back window at a left side of the module;

a security safe place at a bottom of the storage area; and a power panel in the right side module.

* * * * *